United States Patent [19]

Bloxham

[11] Patent Number: 4,510,877

[45] Date of Patent: Apr. 16, 1985

[54] FLOATING DRY DOCK

[76] Inventor: Roger W. Bloxham, P.O. Box 8321, Newport Beach, Calif. 92660

[21] Appl. No.: 933,591

[22] Filed: Aug. 14, 1978

Related U.S. Application Data

[63] Continuation-in-part of Ser. No. 889,454, Mar. 23, 1978, abandoned, which is a continuation-in-part of Ser. No. 847,341, Oct. 31, 1977, abandoned.

[51] Int. Cl.[3] ..... B63C 1/02

[52] U.S. Cl. ..... 114/45

[58] Field of Search ..... 114/44–48, 114/258–260; 405/218, 219

[56] References Cited

U.S. PATENT DOCUMENTS

| | | | |
|---|---|---|---|
| 7,587 | 8/1850 | Winslow | 114/45 |
| 903,598 | 11/1908 | Mehlhorn | 114/45 |
| 984,133 | 2/1911 | Giese | 114/45 |
| 1,043,411 | 11/1912 | Engstrand | 114/45 |
| 1,300,954 | 4/1919 | Gray | 114/259 |
| 3,976,022 | 8/1976 | Lapeyre | 114/45 |

FOREIGN PATENT DOCUMENTS

| | | | |
|---|---|---|---|
| 477545 | 6/1929 | Fed. Rep. of Germany | 114/45 |

*Primary Examiner*—Trygve M. Blix
*Assistant Examiner*—Jesûs D. Sotelo
*Attorney, Agent, or Firm*—Klein, Szekeres & Fischer

[57] ABSTRACT

A dry dock having flotation chambers on two opposite sides of the load-carrying platform is submerged by flooding the flotation chambers. A reversible air pump is used to raise the dry dock by first blowing water out of the chambers then sucking water from the platform into the chambers and then again blowing water out of the chambers. The structure of the dry dock allows it to be used also as a submergible barge.

14 Claims, 8 Drawing Figures

FLOATING DRY DOCK

CROSS REFERENCE TO RELATED APPLICATION

This application is a continuation-in-part of co-pending application Ser. No. 889,454, filed Mar. 23, 1978, now abandoned, which is a continuation-in-part of application Ser. No. 847,341, filed Oct. 31, 1977, now abandoned.

BACKGROUND OF THE INVENTION

This invention relates to the field of submergible floating vessels, particularly floating dry docks and barges. In particular, this invention relates to a new type of submergible floating dry dock or barge and a method for using same which is especially well adapted for use both in very shallow bodies of water and in the open ocean and which is simple and economical in both construction and operation.

Submergible floating dry docks have been in use for many years. Such dry docks operate by the use of flotation chambers which are flooded with water to submerge the dock. Air is then introduced into these chambers to displace the water therefrom, thereby raising the dock and the vessel held within its hold. Various mechanisms have been devised to achieve the submersion and flotation functions of such a dry dock. However, the typical floating dry dock requires the use of flotation chambers underlying the deck or platform of the hold as well as along the sides of the hold. Such a construction results in a structure which extends several feet below the deck or platform, and thus such dry docks can only be used in water which is sufficiently deep to accommodate the entire depth of this sub-deck structure. Therefore, the use of such dry docks is precluded in many of the shallow bays and inlets where many marinas for small, relatively shallow-draft pleasure craft are located. Also, the substantial thickness of the bottom structure in such dry docks makes them difficult to use in salvage operations where, for example, it is necessary to raise a vessel which is resting on the bottom of a body of water. This difficulty arises from the necessity to lift the sunken vessel vertically several feet so as to clear the underdeck flotation structure of the dry dock. Furthermore, because the ballast in such dry docks is located under the load, the shifting of the ballast under the load due to, for example, rough weather conditions, can produce a severe instability which may result in capsizing. The same problem is present in conventional submergible barges.

SUMMARY OF THE INVENTION

The present invention overcomes the aforementioned disadvantages of the prior art by providing a floating dry dock or barge having no structure underlying the deck or the platform in the hold. The present invention also provides a dry dock or barge which is ingenious in its simplicity of construction, and which also provides for a great degree of control in leveling when loaded.

The dry dock or barge of the present invention is comprised of a hold, the bottom of which is provided by a deck or platform preferably of a rectangular configuration. A lateral flotation chamber is disposed along each of the longer sides of the platform and the inner walls of these floation chambers provide the hold walls along the sides. The bottoms of the flotation chambers are flush with the bottom of the deck or platform thereby permitting submersion of the platform so that the bottom of the platform rests on the bottom of the water body and the upper surface of the platform is above the bottom only by the thickness of the platform which may be as little as one foot.

Each of the chambers is divided by transverse vertical bulkheads into a number of separate compartments, preferably three. Each compartment is coupled by a hose to a reversible air pump. Each chamber includes a number of water intake ports suitably spaced near the juncture of the chamber and the floor of the deck. These ports permit water to be drawn from the hold into the chambers and are provided with check valves which open into the chamber in response to air being drawn from the chamber by means of the pump. Each compartment is provided a water outlet port opening to the exterior of the dry dock or barge and containing a check valve which opens in response to air being blown into the chamber by the pump.

One end of the hold is closed by means of a gate which may be conveniently operated through a pneumatic mechanism driven by the air pump. The gate is hinged at its juncture with the deck and closes to fit against the ends of the chambers to provide a water-tight hold. The other end of the hold may be closed off by means of a fixed wall or, if so desired, another gate may be provided at that end.

DETAILED DESCRIPTION OF THE INVENTION

In the following description of the invention, the invention is referred to, in most cases, as simply a dry dock, for the sake of simplicity. However, as will presently be made clear, the invention is equally suited for use as a submergible barge, and, accordingly, may be conceived of as a multi-purpose submergible vessel.

Figure 1:
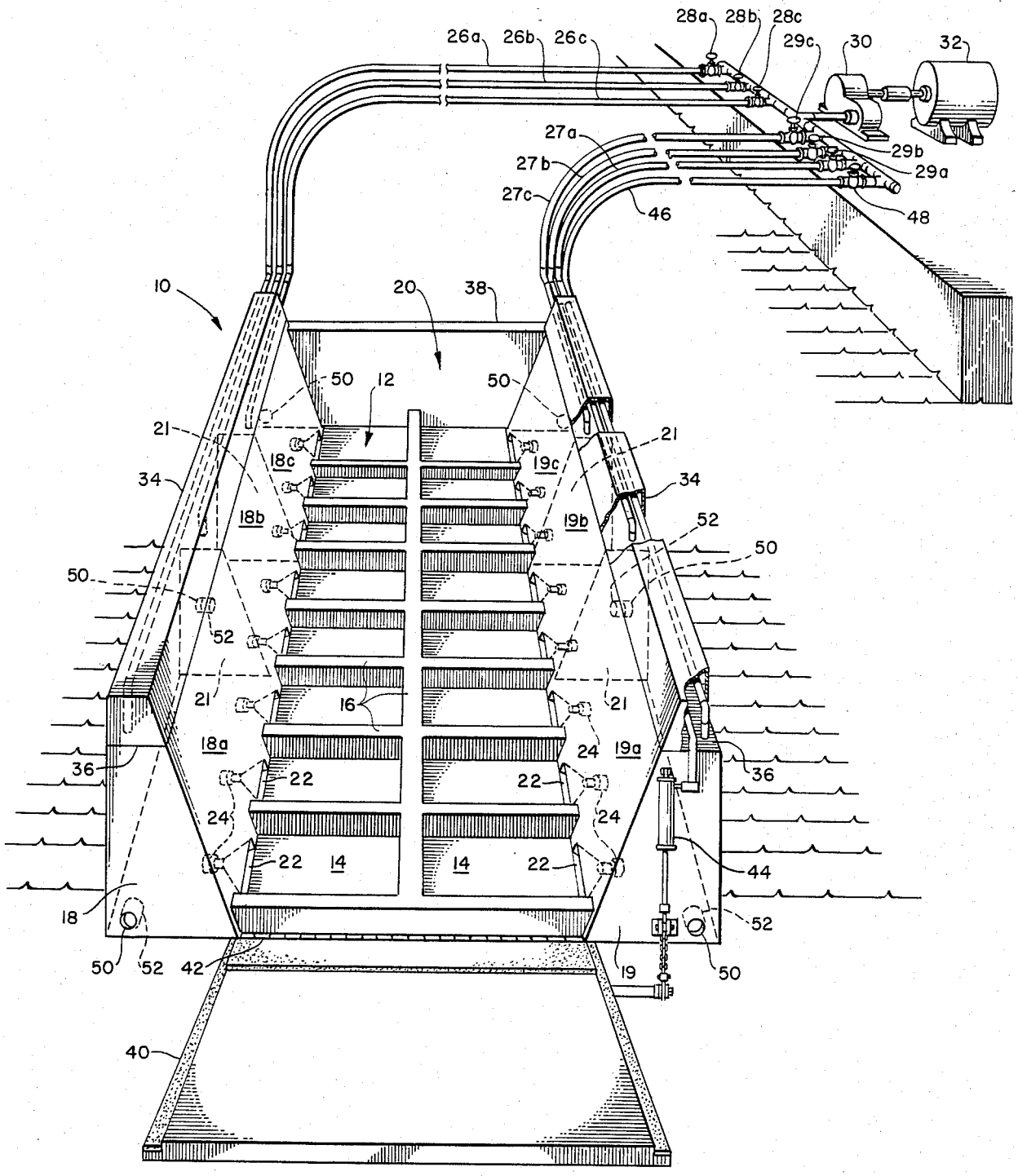
FIG. 1 is a perspective view of the invention.

Referring to FIG. 1, a floating dry dock 10 is provided with a deck or platform 12. The deck 12 is comprised of a solid floor 14, preferably of reinforced concrete, and may advantageously include a grid of structural load-bearing members 16 to lend structural strength and rigidity to the dry dock. A cradle or shoring structure 17 may be conveniently provided on the deck 12 to carry the vessel, as shown in FIGS. 3–6.

Flotation chambers 18 and 19 are provided along opposite sides of the deck 12, rising upward therefrom so as to provide the structural walls for a hold 20. The bottom surfaces of the flotation chambers 18 and 19 are flush with the bottom surface of the deck 12, as is more clearly shown in FIGS. 2–6. The chambers 18 and 19 are each preferably divided into separate, water-tight compartments 18*a*, 18*b*, 18*c*, and 19*a*, 19*b*, 19*c*, respectively, by means of vertical transverse bulkheads 21.

The chambers 18 and 19 are each provided with a number of water intake ports 22 which provide a passage for water from the hold 20 into the chambers 18 and 19. The ports 22 are situated adjacent the deck 12 and are spaced between the structural members 16. Each of the intake ports 22 is provided with an inwardly opening check valve 24 which will open when the pressure on the chamber side of the valve is less than the pressure on the hold side, permitting water to flow only from the hold 20 into the chambers 18 and 19.

The compartments 18*a*, 18*b*, and 18*c* are served by air hoses 26*a*, 26*b*, and 26*c*, respectively, which communicate, via air valves 28*a*, 28*b*, and 28*c*, respectively, with a reversible air pump 30 driven by a motor 32. The compartments 19*a*, 19*b*, and 19*c* are similarly served by hoses 27*a*, 27*b*, and 27*c*, respectively, which communicate with the air pump 30 via air valves 29*a*, 29*b*, and 29*c*, respectively. The hoses 26*a*, 26*b*, 26*c*, and 27*a*, 27*b*, and 27*c*, run through the upper portions of the chambers 18 and 19, respectively, and are contained within sealed air-filled enclosures 34 which are separated from the water-tight compartments by water-tight horizontal bulkheads 36.

One end of the dry dock is enclosed by a fixed wall 38. The opposite end is provided with a gate 40 which is pivotally attached to the deck 12 by means of a hinge 42. The gate is operated by means of a pneumatic cylinder 44 which communicates with the pump 30 by means of an air hose 46 and a gate control valve 48. As may be seen from FIG. 1, the air hose 46 may be conveniently passed through one of the enclosures 34. When shut against the ends of the chambers 18 and 19, the gate 40 provides a water-tight seal for the hold 20.

Each of the compartments 18*a*, 18*b*, 18*c*, 19*a*, 19*b*, and 19*c* has an outlet port 50 provided with an outwardly opening check valve 52 which opens when pressure inside the compartment is greater than the pressure outside the compartment, permitting water to flow only out of the compartments.

Figure 2:
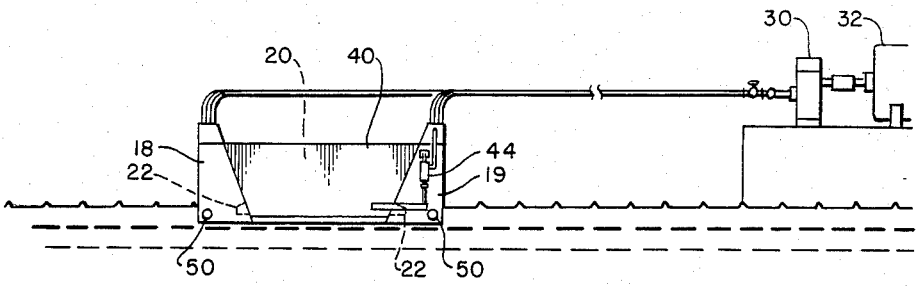
FIGS. 2, 3, 4, 5, and 6 compose a sequence of schematic end views of the invention showing its manner of operation.

The operation of the dry dock may be seen from the schematic drawings of FIGS. 2–6. FIG. 2 shows the dry dock afloat with the gate 40 closed to provide a water-tight hold. The chambers 18 and 19 are filled with air, with the intake valves 24 and the outlet valves 52 closed.

Figure 3:
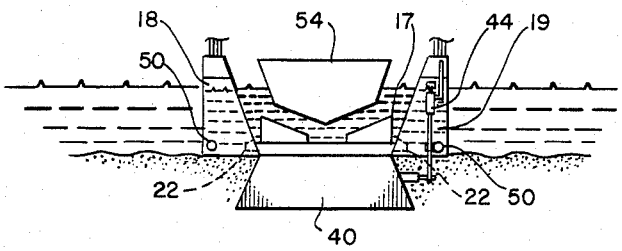

Submerging the dock is accomplished by opening the gate 40, as illustrated in FIG. 3, permitting water to flood the hold 20. The chambers 18 and 19 are also flooded by opening all of the air valves 28*a*, 28*b*, 28*c*, 29*a*, 29*b*, and 29*c* and pumping air out of the chambers 18 and 19 which opens the intake valves 24, permitting water from the hold 20 to enter the chambers 18 and 19 through the intake ports 22. Once the dry dock is submerged, the air valves are closed, and a boat 54 to be dry-docked is positioned over the dry dock. Alternatively, the dry dock may be moved into position under the boat.

Figure 4:
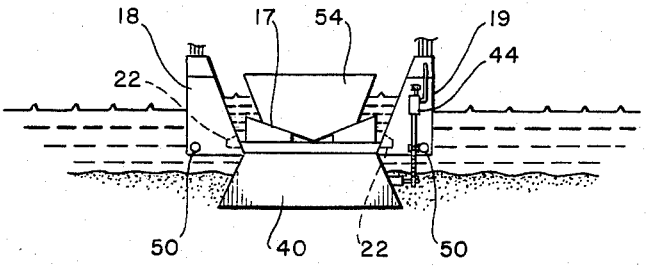

The first step in raising the dry dock is illustrated in FIG. 4. The air valves are again opened, but the pump 30 is reversed, and air is now pumped *into* the chambers 18 and 19, pressurizing the chambers so that the intake valves 24 are shut and the outlet valves 52 are opened. The air pumped into the chambers 18 and 19 expels the water from the chambers through the outlet ports 50. When the chambers are empty, the air valves are shut, and the outlet check valves, no longer opened by the over-pressure within the chamber, close to prevent water from re-entering the chambers through the outlet ports 50.

Figure 5:
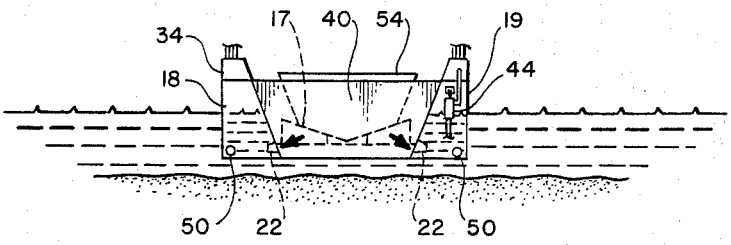
Figure 6:
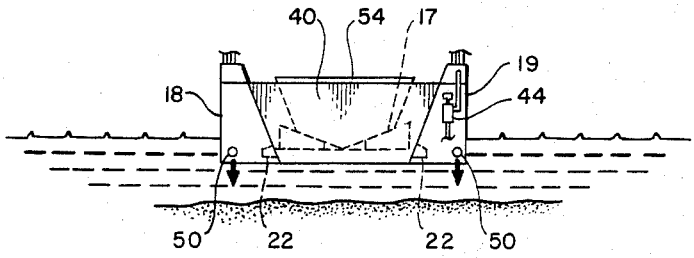

FIG. 5 illustrates the second step in the dock-raising procedure. The gate 40 is closed, sealing the hold 20 and making it water-tight. Once again the air valves are opened, and air is pumped *out* of the chambers 18 and 19, as was done in submerging the dry dock. Again, the suction so created opens the intake valves 24, permitting the water in the hold 20 to be drawn into the chambers 18 and 19 through the intake ports 22. This action is continued until the hold 20 is emptied of water or until the chambers 18 and 19 are filled to capacity, whichever occurs first, and then the air valves are shut.

During this step in the procedure, it may be discovered that the dock will be inclined, either lengthwise or side-to-side, due, for example, to an uneven weight distribution of the boat carried therein, or to a non-centralized positioning of the boat in the hold. To correct this situation, the operator may initiate a leveling procedure at this point by selectively adjusting one or more of the air valves 28*a*, 28*b*, 28*c*, 29*a*, 29*b*, 29*c* to suck varying quantities of water into the compartments 18*a*, 18*b*, 18*c*, 19*a*, 19*b*, 19*c*. For example, if the dry dock is suffering a side-ways inclination, with the chamber 19 lower than the chamber 18, the operator may shut the valves 28*a*, 28*b*, 28*c* when the area of the hold adjacent the chamber 18 is dry, leaving open the valves 29*a*, 29*b*, 29*c* to draw water only into the chamber 19. If the dock is inclined lengthwise, with the compartments 18*a* and 19*a* lower than the compartments 18*c* and 19*c*, the operator may adjust the air valves so that the compartments 18*c* and 19*c* are shut off from the air pump when the water has been sucked from the area of the hold at that end of the dock. Then, after the water has been removed from the middle area of the dry dock, the air valves may be adjusted to shut off compartments 18*b* and 19*b* from the air pump, while continuing the pumping action in compartments 18*a* and 19*a* until the hold is completely free of water. A similar procedure may be used if the dry dock suffers an inclination that is both lengthwise and side-to-side.

The operator, having individual control over the pumping action in each compartment, may carefully adjust the air valves to draw only water, and not air, into each compartment from the hold, and he may carefully regulate the amount of water drawn into each compartment. In this manner the dry dock is prepared to be fully leveled in the next and final step of the dock-raising procedure, illustrated in FIG. 6.

In the third and final step, the air valves are opened, and air is once again pumped *into* the chambers 18 and 19. The over-pressure resulting in the chambers forces the outlet valves 52 open and expels the water from the chambers 18 and 19 out of the outlet ports 50, as in the first step of the raising procedure. If all of the water in the hold 20 had not been previously drawn into the chambers 18 and 19 in the previous (second) step, it will be necessary to repeat the previous step and then proceed to the final step once again. Depending upon the depth of water contained in the hold 20 prior to the second step, and the size of the chambers 18 and 19 in proportion to the hold, it may be necessary to cycle through the second and third steps several times to remove all the water from the hold.

If a leveling procedure had been initiated in the previous step, a fully level position can now be achieved by selectively adjusting the air valves so as to pump varying amounts of air at varying pressures into the individual compartments to expel varying amounts of water from selected compartments until a fully level floating position is achieved. For example, after the previous step, some compartments may be more deeply submerged than others because more water has been drawn into them from the hold. Therefore, the operator will selectively adjust the air valves to pump the appropriate volume and pressure of air into each of the compartments so that the more deeply submerged compartments will be evacuated of water more fully than will the remaining compartments, leaving a sufficient quantity of water as ballast in the remaining compartments to counter-balance the unbalanced load in the hold, thereby effecting a fully level floating position. Thus, the compartments are made to serve as ballast tanks. With his individual control over the air supply to each of the six compartments, the operator may thus achieve a fully level position from any non-level orientation of the dry dock.

The entire process of submerging, re-floating, and leveling the dry-dock of the present invention can be accomplished by a single operator in less than one hour, as compared with prior art floating dry docks, in which the process usually requires several hours.

Figures 7, 8:
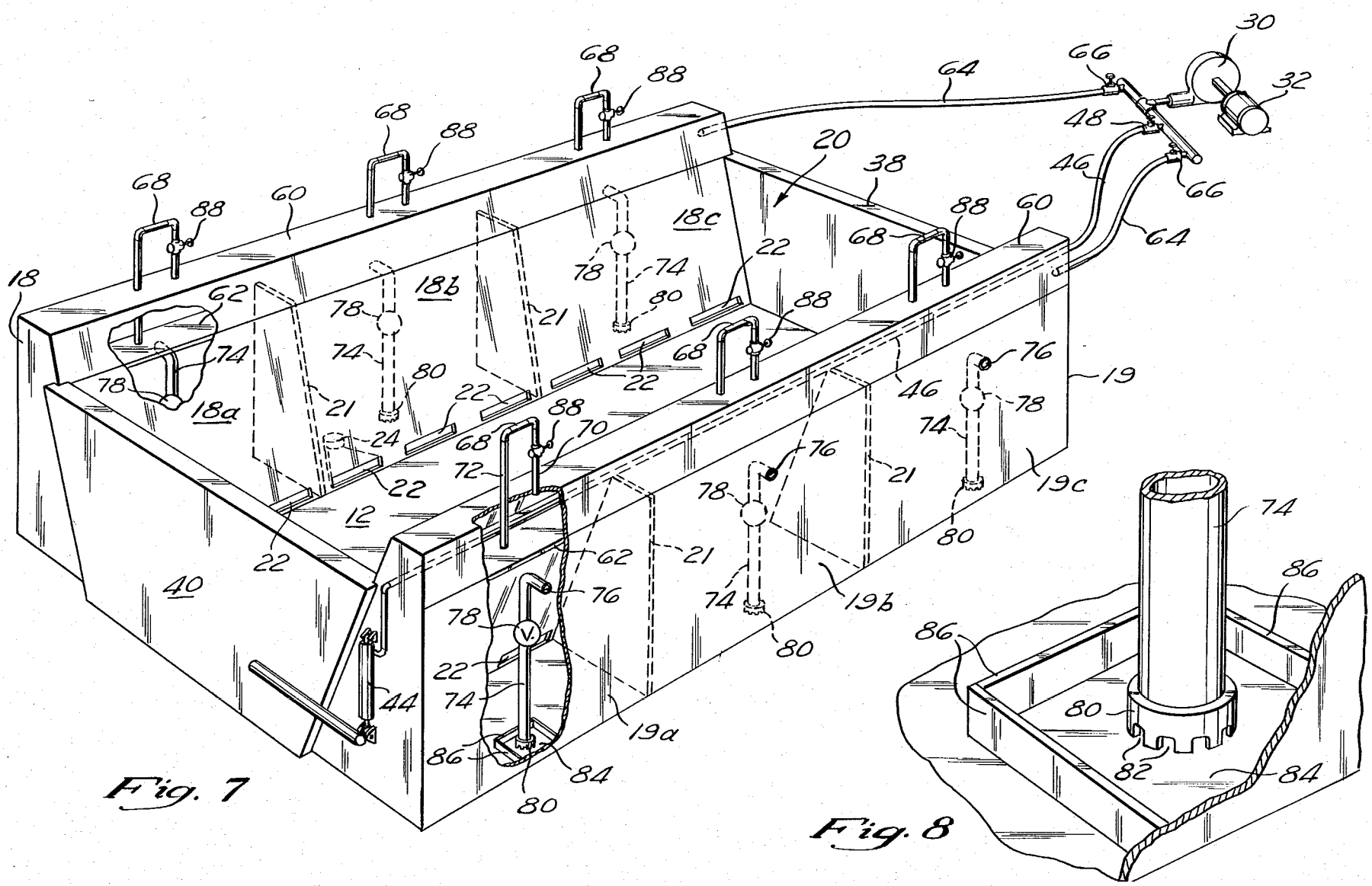
FIG. 7 is a perspective view, partially in section, of the invention incorporating certain modifications.
FIG. 8 is an enlarged perspective view of the lower portion of one of the risers shown in FIG. 7.

FIGS. 7 and 8 show the present invention incorporating modifications to the air supply and water evacuation systems.

The modified air supply system comprises a pair of air-tight air-supply enclosures or manifolds 60 along the upper portions of the chambers 18 and 19. The manifolds 60 are separated from the flotation/ballast compartments 18*a*, 18*b*, 18*c*, 19*a*, 19*b*, and 19*c* by air- and water-tight horizontal bulkheads 62. The reversible air pump 30, driven by the motor 32, alternately pumps air into and out of the manifolds 60 through a pair of air hoses 64. The air flow through each of the hoses 64 may be advantageously controlled by a valve 66.

Air is conducted between the manifolds 60 and the respective flotation/ballast compartments by means of a plurality of generally inverted U-shaped pipes 68, each compartment being served by one of the pipes 68. Each of the pipes 68 has a short leg 70 opening ihto the manifold 60 and extending upwardly through the top thereof, and a long leg 72 extending downwardly through the manifold 60 and the horizontal bulkhead 62, and opening into the compartment immediately below. The purpose of this configuration will be apparent from the description of the operation of this air supply system hereinbelow.

The modified water evacuation system incorporates a stand-pipe or riser 74 in each of the flotation/ballast compartments. Each of the stand-pipes or risers 74 has an outlet port 76 opening to the exterior of the dry dock, preferably above the loaded water line thereof, and each of the risers 74 is provided with an outlet valve 78, which is a one-way check valve which permits water to flow only out of the compartment.

Referring particularly to FIG. 8, the bottom of each of the risers 74 is terminated by an inlet collar 80 having plural openings 82 to permit water to flow into the riser. Each of the inlet collars 80 is located in a segregated area 84 of the chamber floor formed by a plurality of short, vertical barrier members 86 in combination with the inner surface of the outer wall of the flotation/ballast compartment. As will be presently seen, a shallow reservoir, at all times filled with water, is provided in each of the segregated floor areas 84.

When it is desired to evacuate water from the flotation/ballast compartments, air is pumped into the manifolds 60, positively pressurizing them, so that the air enters the short legs 70 of the pipes 68. The air is then conducted through the long legs 72 of the pipes 68 into the compartments. The increased pressurization in the compartments forces the water therein into the riser inlet openings 82, up through the risers 74, past the one-way check valves 78, and out to the exterior of the dry dock through the outlet ports 76.

The pressure delivered to the compartments via the pipes 68 must be approximately the pressure needed to raise the water therein a height equal to the height which the risers 74 rise above the tops of the barrier members 86. Thus, the compartments cannot be completely evacuated, but will contain at least a minimum level of water equal to the height of the members 86. If a compartment were to become completely evacuated of water before other compartments were emptied, the sudden decrease in pressure in the evacuated compartment would result in all of the air in the manifold 60 being directed along the path of least resistance, i.e., into the evacuated compartment. Consequently, it is necessary to provide a "water dam" at the intake of the risers to ensure that no compartment becomes depressurized during the evacuation process. It is for providing such a water dam that the segregated floor areas or reservoirs 84 are provided. Since the level of water in the compartments will never be below the tops of the barrier members 86, the barrier members 86, in combination with the inner surface of the outer wall of the compartment, trap a shallow pool of water around the intake collar 80 of the riser 74, blocking the intake openings 82. This pool will remain in the reservoir 84 even when the vessel is slightly tipped so that the water in the compartment outside of the reservoir is displaced to one side of the compartment. The water in the reservoir effectively prohibits the escape of air through the riser, so that the compartment remains pressurized, thus allowing air to be delivered to the as yet unemptied compartments at a pressure sufficient to effect the evacuation thereof. It is important that the reservoirs 84 each have a capacity at least approximately equal to that of the risers 74, so that the water can never be completely evacuated from the reservoirs into the risers.

A significant advantage of the use of the risers 74 is that in locating the outlet ports 76 above the loaded water line of the dry dock, the risk of inadvertently flooding any of the compartments, should one of the check valves 78 fail, is minimized.

When it is desired to draw water into the flotation/-ballast compartments through the inlet ports 22, the pump 30 is reversed, as previously described, so that a negative pressure is delivered to the manifolds 60, drawing air out of the compartments, through the pipes 68, and into the manifolds 60. The depressurization of the compartments will, as previously described, cause water to be drawn into the compartments from the hold 20 through the inlet ports 22 and the inlet valves 24 (only one of which is shown in FIG. 7 for the sake of clarity). As the compartments become filled to nearly their full capacity, means must be provided to prevent the water from being drawn into the air manifolds 60 through the pipes 68, since the manifolds 60 also serve as permanent flotation chambers. Accordingly, the long legs 72 of the pipes 68 rise above the horizontal bulkheads 62 to a height that is greater than the head of water which would be raised by the suction applied to the pipes 68. If the suction supplied by the pump 30 in the compartment-filling operation is equal in magnitude to the pressure supplied during the water-evacuation process, the length of the long legs 72 of the pipes 68 must be greater than the length of the risers 74.

Each of the pipes 68 is provided with a pressure regulator valve 88. The pressure regulator valves 88 are normally set to provide the optimum level of pressure/-suction which will allow the dry dock to operate in the manner described above This optimum level will be determined by the dimensions of the various components of the dry dock, particularly the risers 74 and the pipes 68. For example, if the risers have a height of six feet above the tops of the reservoir barrier members 86, a pressure of approximately 2.5 psi is necessary to raise the water to the level of the outlet ports 76. Thus, assuming the suction applied during the compartment-filling stage is equal in magnitude to this pressure, the long legs 72 of the pipes 68 must rise more than six feet above the compartments to ensure that no water is introduced into the manifolds 60. Should it be desired to isolate a particular compartment from the air supply, as during the previously described leveling operation, the valve 88 serving that compartment may be shut off. It is preferable that the valves 88 be actuated electrically by an operator located at a remote station, but they may also be actuated manually on board the dry dock.

The foregoing discussion, along with the FIGS. 2–6, demonstrates the unique ability of the present invention to function in very shallow water, due to the total lack of any flotation structure below the level of the deck 12. Thus, the dry dock may be operated as long as there is a sufficient depth of water beneath the vessel to be raised to clear the thickness of the deck 12, which may be as little as one foot. This structure in no way detracts from the utility of this invention in deep water; indeed, the present invention is uniquely advantageous in the raising of sunken vessels which rest on the bottom of a body of water. In this application, the dock is submerged to rest on the bottom of the body of water, and the sunken vessel need only be raised to clear the thickness of the deck 12. Thus, the lack of sub-deck flotation structure obviates the necessity of substantial lifting of the sunken vessel.

This same feature makes the present invention most useful in undersea mining, as, for example, the retrieval of mineral modules from the sea bed. In such an application, the present invention would function essentially as a submergible barge.

The lack of flotation structure beneath the level of the deck results in additional advantages. For example, as most clearly shown in FIG. 6, when the dry dock is raised with the vessel in the hold, the deck is actually below the level of the surface of the water. This results in the water underlying the deck acting so as to support the load on the deck, since the water will exert an upward pressure on the bottom surface of the deck, the pressure being proportional to the deck's depth of submergence below the water's surface. Thus, the construction of a dry dock in accordance with the present invention results in the utilization of the underlying water as a structural support for the load, thus eliminating the need for a thick, heavy, structurally reinforced deck, such as is necessary in those dry docks which have side pontoons which lift the deck out of the water. Thus, the deck in the present invention may be conveniently made with the relatively thin, essentially solid construction shown in the drawings.

Furthermore, by utilizing flotation chambers which maintain the water ballast at or above the level of the deck, the present invention displays a marked advantage in stability over dry docks and barges which incorporate flotation or ballast compartments beneath the deck. In such vessels, it is necessary to use a multitude of relatively small compartments, or else a slight tipping of the vessel when the flotation compartments are partially filled with water ballast will result in the water rushing to the lower side of the dry dock. This action of the water ballast within the flotation compartments will thus tend to aggravate the tipping condition which, if not otherwise controlled, may result in the capsizing of the vessel, especially if it is in rough water due to inclement weather. The use of a multi-compartmentalized sub-deck flotation structure can minimize this instability, but at the expense of increased complexity and cost of construction. By totally eliminating this sub-deck flotation structure, the present invention also eliminates the problems presented by such a structure. Specifically, since the flotation/ballast chambers 18 and 19 of the present invention carry the ballast on opposite sides of the load at or above the level of the deck, there can, of course, be no shifting of the ballast beneath the load. Moreover, if the amounts of ballast in the two flotation chambers are maintained equal to one another during the raising process, equal lift will be produced on two relatively widely separated sides of the load. Consequently, there will be a substantial self-righting moment produced by the flotation chambers at all times during the raising process.

Looked at another way, the self-righting ability of the present invention derives from the fact that with all of the flotation/ballast structure at or above the level of the deck, the vessel has a center of gravity which becomes *lower* as the flotation chambers 18 and 19 are emptied during the raising process. Consequently, once the vessel achieves a positive buoyancy, any tipping of the vessel will produce a metacenter which will be *higher* than the vessel's center of gravity, even if the vessel is loaded to its capacity, thereby generating a self-righting moment which opposes the tipping. This is in contrast with the prior art submergible barges and dry docks, in which the emptying of the sub-deck ballast tanks during the raising process moves the center of gravity *higher*. Consequently, there comes a time during the raising process, after the vessel has achieved a positive buoyancy, when any tipping will produce a metacenter which is *below* the center of gravity, producing a moment in the same direction as the tipping. If left unchecked, this situation will result in the capsizing of the vessel.

Accordingly, prior art submergible barges and dry docks must be raised quite slowly, and great care must be taken to prevent the shifting of the load. Furthermore, the tipping of the vessel must often be substantially eliminated by the use of external restraints, such as cables and anchors. Moreover, the inherent instability of such prior art vessels makes their use in rough water unsafe.

On the other hand, the inherent stability of the present invention, and its ability to produce self-righting forces while it is being raised, allows the vessel to be raised relatively quickly, with a great degree of safety, even in rough water, and without the need for external restraints. The manifold advantages of such characteristics will be readily apparent to those who use such vessels.

I claim:

1. A floating, submergible vessel, comprising:

a hold having a deck for carrying a load;

floodable flotation means along opposite sides of said deck for alternately raising and lowering said vessel in a body of water, said flotation means comprising (a) a compartment for holding water as ballast for said vessel, and (b) air manifold means located above said compartment and in fluid communication therewith;

water inlet means in said flotation means adjacent said deck for permitting water to be drawn from said hold into said compartment in response to the evacuation of air from said flotation means;

water outlet means in said flotation means for permitting water to be discharged from said compartment to the exterior of said vessel in response to the introduction of air into said flotation means;

means for selectively supplying a negative or a positive air pressure into said manifold means;

conduit means for conducting air between said manifold means and said compartment, said conduit means including means for preventing the drawing of water from said compartment into said manifold means through said conduit means in response to said negative pressure; and gating means on said deck for permitting the flooding of said hold when said gating means is open and for sealing said hold when said gating means is shut.

2. A floating, submergible vessel, as defined in claim 1, wherein said flotation means include vertical transverse partition means for dividing said flotation means into a plurality of separate compartments.

3. A floating, submergible vessel, as defined in claim 1, wherein said deck, when carrying a load, is lower than the surface of said body of water.

4. A floating, submergible vessel, as defined in claim 1, wherein said flotation means is disposed substantially entirely above the level of said deck.

5. A floating, submergible vessel, as defined in claim 1, wherein said conduit means comprises:

a generally inverted U-shaped pipe having a relatively long vertical leg communicating with the interior of said compartment and a relatively short vertical leg communicating with the interior of said manifold means, said long leg extending above said compartment to a height which is higher than the height of the head of water which would be raised by said negative pressure.

6. A floating, submergible vessel, as defined in claim 1, wherein the water is discharged by said outlet means above the loaded water line of said vessel.

7. A floating, submergible vessel, as defined in claim 6, wherein said water outlet means comprises a riser extending above said loaded water line.

8. A method for placing a boat into a dry dock having a hold and a flotation chamber, comprising:

submerging said dry dock by flooding said hold and said flotation chamber with water;

positioning said dry dock and said boat so that said hold directly underlies said boat;

evacuating the water from said flotation chamber exteriorly by pumping air into said chamber;

drawing water from said hold into said chamber by pumping air out of said chamber; and evacuating the water from said chamber exteriorly by pumping air into said chamber.

9. The method defined in claim 8, wherein said flotation chamber is flooded by pumping air out of said chamber, the suction thereby created drawing water from said hold into said chamber.

10. A method for submerging and raising a floating vessel having a hold and a flotation chamber, comprising:

opening said hold and said chamber to permit the flooding thereof with water from the surrounding body of water;

evacuating water from said chamber into said body of water by pumping air into said chamber;

sealing said hold;

drawing water from said hold into said chamber by pumping air out of said chamber; and again evacuating water from said chamber into said body of water by pumping air into said chamber.

11. A method for placing a boat into a dry dock having a hold and multiple flotation compartments, comprising:

submerging said dry dock by flooding said hold and said flotation compartments with water;

positioning said dry dock and said boat so that said dry dock directly underlies said boat;

evacuating the water from said compartments by pumping air into said compartments;

selectively pumping air out of the least deeply submerged of said compartments to draw water from an area of said hold adjacent said least deeply submerged compartments until said area is substantially dry, repeating this procedure for progressively more deeply submerged compartments and the areas of said hold adjacent thereto until the entire hold is substantially dry; and selectively pumping air into the most deeply submerged of said compartments to evacuate a sufficient quantity of water therefrom to level said dry dock.

12. A floating, submergible vessel, comprising:

a hold having a deck on which a load is carried, said deck having a top surface and a bottom surface;

a flotation chamber on each of two opposite sides of said deck, each of said flotation chambers having a bottom substantially on a level with said deck, each of said flotation chambers being floodable with water from said hold in response to the evacuation of air from said chambers to submerge said vessel;

outlet means for discharging said water from said chambers in response to the introduction of pressurized air into said chambers to raise said vessel;

air manifold means selectively suppliable with a positive or negative air pressure; and conduit means for conducting air between said chambers and said manifold means, said air being evacuated from said chambers into said manifold means through said conduit means in response to said negative pressure and introduced into said chambers from said manifold means through said conduit means in response to said positive pressure, said conduit means including means for preventing the drawing of water from said chambers into said manifold means through said conduit means in response to said negative pressure.

13. A floating, submergible vessel, as defined in claim 12, wherein said manifold means comprises an air-tight enclosure above each of said chambers, and said conduit means comprises at least one generally inverted U-shaped pipe in each of said enclosures, each having a relatively long vertical leg communicating with the interior of the chamber underlying the enclosure in which said pipe is located, and a relatively short vertical leg communicating with the interior of the enclosure in which said pipe is located, said long leg extending above said chamber to a height which is higher than the height of the head of water which would be raised by said negative pressure.

14. A floating, submergible vessel, as defined in claim 12, wherein said chambers provide a self-righting moment to said vessel when said vessel is tipped at any time while said vessel is being raised.

* * * * *